US008381490B2

(12) United States Patent
Back et al.

(10) Patent No.: US 8,381,490 B2
(45) Date of Patent: Feb. 26, 2013

(54) DUAL GLAZED FRAMING SYSTEM FOR ENCAPSULATING TRANSLUCENT INSULATING PARTICULATE MATERIAL AND METHOD OF MAKING SAME

(76) Inventors: Mark A. Back, Myrtle Beach, SC (US); J. Michael Riley, Swinton (GB); John E. Welsh, Port St. Lucie, FL (US)

( * ) Notice: Subject to any disclaimer, the term of this patent is extended or adjusted under 35 U.S.C. 154(b) by 0 days.

(21) Appl. No.: 12/855,993

(22) Filed: Aug. 13, 2010

(65) Prior Publication Data

US 2011/0036027 A1 Feb. 17, 2011

Related U.S. Application Data

(60) Provisional application No. 61/234,143, filed on Aug. 14, 2009.

(51) Int. Cl.

| | |
|---|---|
| ***E04B 7/18*** | (2006.01) |
| ***E06B 3/68*** | (2006.01) |
| ***E04C 2/54*** | (2006.01) |
| ***E04C 2/34*** | (2006.01) |

(52) U.S. Cl. ..... 52/786.1; 52/200; 52/794.1; 52/204.6

(58) Field of Classification Search ..... 52/200, 52/306, 783.1, 786.1, 786.11, 788.1, 794.1, 52/204.593, 172, 204.63, 204.64, 204.65, 52/204.6; 428/34

See application file for complete search history.

(56) References Cited

U.S. PATENT DOCUMENTS

| | | | | |
|---|---|---|---|---|
| 2,383,691 | A * | 8/1945 | Smith | 52/204.593 |
| 5,088,258 | A * | 2/1992 | Schield et al. | 52/204.593 |
| 5,461,840 | A * | 10/1995 | Taylor | 52/786.13 |
| 5,784,853 | A * | 7/1998 | Hood et al. | 52/786.13 |
| 6,370,838 | B1 * | 4/2002 | Evason et al. | 52/786.13 |
| 6,401,428 | B1 * | 6/2002 | Glover et al. | 52/786.13 |
| 2006/0144013 | A1 * | 7/2006 | Rouanet et al. | 52/782.1 |
| 2008/0302059 | A1 * | 12/2008 | Du Plessis et al. | 52/786.11 |
| 2010/0146880 | A1 * | 6/2010 | Valentz et al. | 52/200 |
| 2010/0163157 | A1 * | 7/2010 | Milburn | 156/99 |
| 2011/0195206 | A1 * | 8/2011 | Colson | 428/34 |

* cited by examiner

*Primary Examiner* — Joshua J Michener
*Assistant Examiner* — Ryan Kwiecinski
(74) *Attorney, Agent, or Firm* — Wood, Herron & Evans, LLP

(57) ABSTRACT

A skylight or other like panel comprising a dual glazed framing system is provided. The dual glazed framing system includes opposing glazing panels, a frame with supporting ledges, and translucent insulating particulate material is encapsulated in a insulating cavity defined by the frame and the opposing panes. A movable fill guide is provided and allows for the compression of the translucent insulating particulate material. A method of creating a dual glazed framing system filled with translucent insulating particulate material is also provided.

20 Claims, 4 Drawing Sheets

DUAL GLAZED FRAMING SYSTEM FOR ENCAPSULATING TRANSLUCENT INSULATING PARTICULATE MATERIAL AND METHOD OF MAKING SAME

CROSS-REFERENCE TO RELATED APPLICATIONS

This application claims the benefit of U.S. Provisional Application No. 61/234,143, filed Aug. 14, 2009 the disclosure of which is hereby incorporated by reference.

TECHNICAL FIELD

The present invention generally relates to a skylight or other like panel comprising a dual glazed framing system, the dual glazed framing system encapsulating translucent insulating particulate material. The present invention further relates to a method of creating a dual glazed framing system filled with translucent insulating particulate material.

BACKGROUND

It is often desirable to use skylights or other like panels in the construction of structures that have an interior space that will be heated or cooled, depending on the season, and an exterior surface that is exposed to the elements. While such skylights can provide light to interior space without the use of any other energy source, or provide desirable aesthetics, they typically lack the insulating value of the other building materials found in the ceilings, roofs, or walls of a structure. Therefore, while skylights or other like panels may provide desirable aesthetic qualities and energy savings with regard to the consumption of energy for the production, they are often an energy drain as to the heat that passes through the panels.

For example, it is typical to construct a skylight or other like panels with more than one glazing in order to utilize the insulating properties of the air trapped between the panes, while still creating a substantially translucent, if not transparent system. However, during cold weather, for example, warm air between the panes of such skylights and panels rises upward, typically the same direction as the primary heat flow through the skylight. The warm air adjacent to the colder upper glazing is cooled and falls, to be replaced repeatedly by more warm air from below. This circulation cycle tends to considerably amplify unwanted heat loss by convection. Additionally, due to typical orientation of skylights, there is often significant unwanted heat loss in the form of radiation to the night sky.

Consequently, there is a need for a skylight system that, while still allowing light to pass through, provides for an increased insulating value so as to also conserve the energy that is otherwise required to heat or cool an interior room or space. It is particularly desirable to increase the insulating value of such a system with minimal reduction to amount of light that passes through the system.

SUMMARY OF THE INVENTION

To these ends, a dual glazed framing system for increasing the insulating value of skylights or other like panels is provided. The dual glazed panel framing system includes a first glazing panel and an opposing second glazing panel. The frame that supports the panels has a first ledge that is adapted to receive the first glazing panel and an opposing second ledge adapted to receive the opposing second glazing panel. In that manner, an insulating cavity is formed between the first glazing panel and the second glazing panel. The insulating cavity of the dual glazed framing system is filled with a translucent insulating particulate material. In one embodiment, the translucent insulating particulate material is an aerogel such as a Nanogel brand sold by Cabot Industries, Boston, Mass.

In another embodiment of the invention, the dual glazed framing system comprises a first and second glazing panel, a frame with a first and second supporting ledge, and an insulating cavity filled with translucent insulating particulate material, further comprises a movable fill guide located at one of the supporting ledges. The movable fill guide facilitates filling the framing system with the insulating material above the supporting ledge. The movable fill guide allows for the compression of the translucent insulating particulate material as it is sealed between the first and second glazing panel in the insulating cavity. In one embodiment, the movable fill guide is a flexible durometer attached to an edge of the frame. In another embodiment, the translucent insulating particulate material is an aerogel.

Prior to the compression of the translucent insulating particulate material, the first panel, the second panel, the frame, and the movable fill guide of the dual glazed framing system define a first space with a first volume of filler. After compression, the first panel, the second panel, the frame, and the movable fill guide define a second space with a second volume of filler; the second volume being less than the first volume. In one embodiment, the first volume of filler is less than 120% of the second volume. In another embodiment, the first volume of filler is about 108% of the second volume.

In yet another aspect, the dual glazed framing system further comprises a frame filler adapted to increase the volume of the insulating cavity. By way of example, it may be advantageous to utilize the frame filler to create a system adapted to contain larger qualities of insulating material to suit the ambient conditions. In that way, for example, the insulating value of the system can be adjusted to suit geographical locations with unusually hot or cold ambient conditions.

In one embodiment, the translucent insulating particulate material, such as an aerogel, is resistant to settling due to gravity or other forces. In that way, for example, the dual glazed framing system resists losing insulating efficiency over time. In other embodiments, the dual glazed framing system may be positioned in a substantially horizontal orientation. In other embodiments, the dual glazed framing system may be positioned in various other orientations. Furthermore, some embodiments may include various shapes and sizes.

The invention further includes a method of creating a dual glazed framing system for skylights or other like panels filled with translucent insulating particulate material. The method includes glazing a first panel to a frame, then filling a volumetric cavity formed by the first panel and the frame with translucent insulating particulate material, and then glazing a second panel to the frame. For example, the translucent insulating particulate material could be an aerogel.

In one embodiment of the inventor, the frame includes a movable fill guide, which is a flexible elastomeric strip which increases the volume of the cavity. In such an embodiment, the method includes the steps of filling the cavity with translucent insulating particulate material, then compressing against the fill guide and the translucent insulating particulate material, and, finally, glazing the second panel to the frame. The movable fill guide is a flexible durometer which moves under compression to reduce the fill volume in turn compressing the fill material.

BRIEF DESCRIPTION OF THE DRAWINGS

The accompanying drawings, which are incorporated in and constitute a part of this specification, illustrate embodiments of the invention and, with the general description given above, together with the detailed description given below, serve to explain various aspects of the invention.

DETAILED DESCRIPTION

Although the invention will be described in connection with certain embodiments, the invention is not limited to practice in any one specific type of skylight or other like panel. The description of the embodiments of the invention is intended to cover all alternatives, modifications, and equivalent arrangements as may be included within the spirit and scope of the invention as defined by the appended claims. In particular, those skilled in the art will recognize that the components of the embodiments of the invention described herein could be arranged in multiple different ways.

Figure 1:
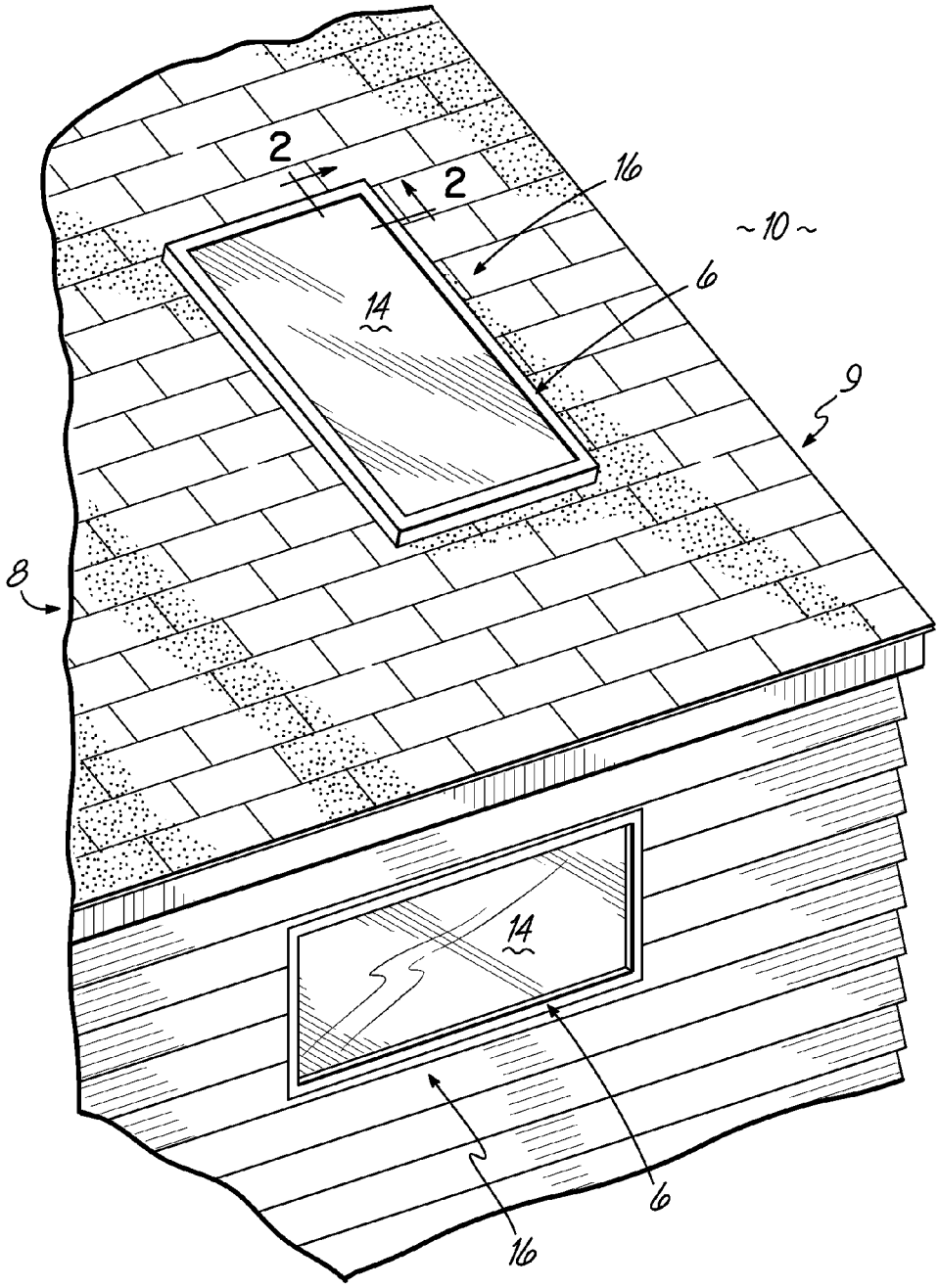
FIG. 1 is a perspective view of the dual glazed framing system shown in an angled orientation and a vertical orientation on a dwelling structure.
Figure 2:
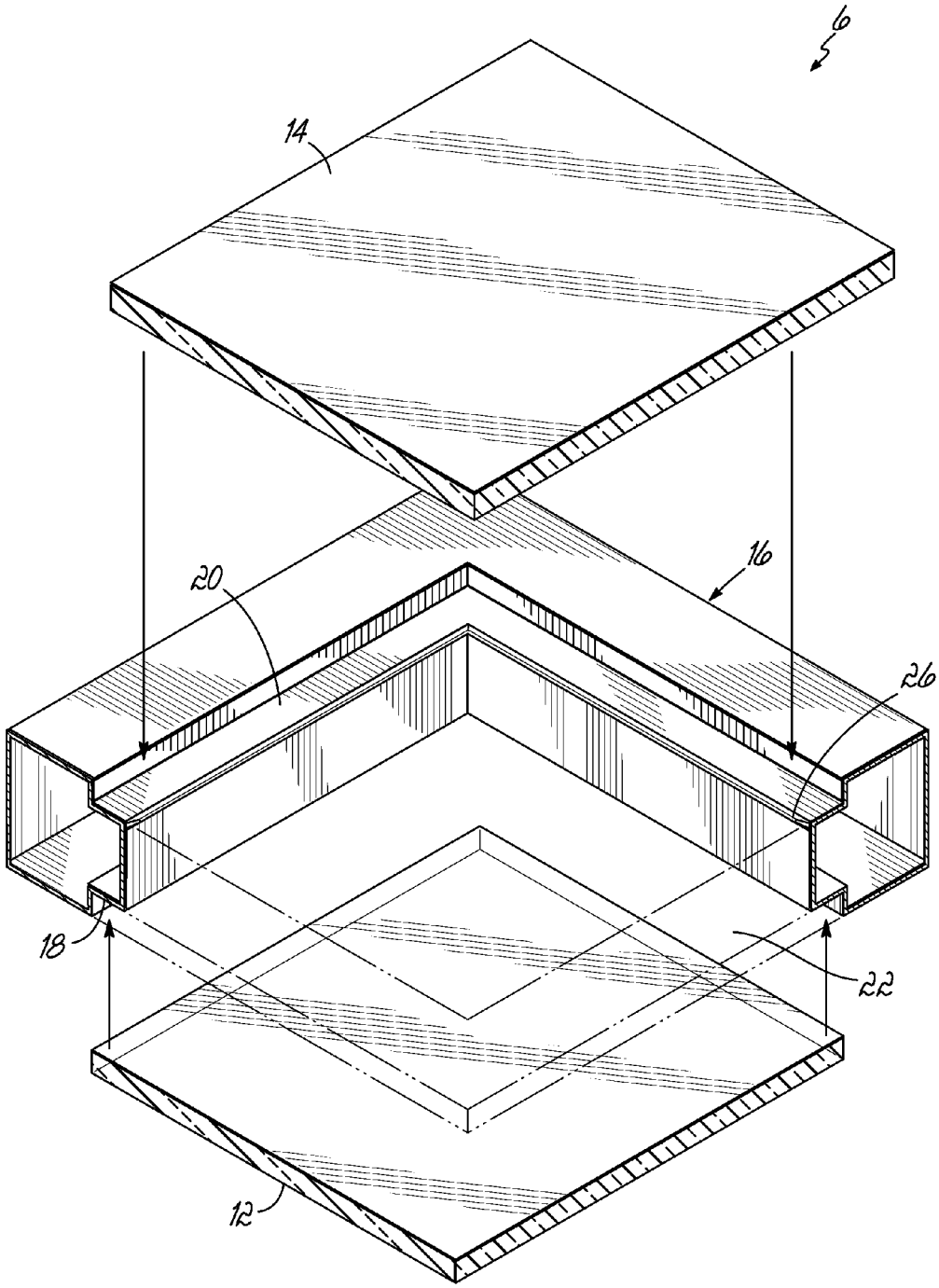
FIG. 2 is an exploded view of the dual glazed framing system.

Referring now to the drawings, specifically FIGS. 1 and 2, a dual glazed framing system 6 is provided. The dual glazed framing system 6 will be described herein with respect to an interior portion 8 which, for example, may communicate with an interior space of a dwelling, and an exterior portion 10 which, for example, may communicate with a space exterior to a dwelling.

With reference to FIG. 2, the dual glazed framing system 6 includes a first glazing panel 12, an opposing second glazing panel 14, and a frame 16 having a first ledge 18 adapted to receive the first glazing panel 12 and an opposing second ledge 20 adapted to receive the opposing second glazing panel 14. The frame 16 can be metal, fiberglass, or PVC, or any other suitable material. Generally, the frame 16 will be PVC or fiberglass to provide insulation. The first glazing panel 12, the opposing second glazing panel 14, and the frame 16 encapsulate an insulating cavity 22 positioned between the first and second panels 12, 14. The insulating cavity 22 is filled with a translucent insulating particulate material 24. In that manner, for example, the translucent insulating particulate material 24 is sandwiched between the first glazing panel 12 and the opposing second glazing panel 14.

Figure 3:
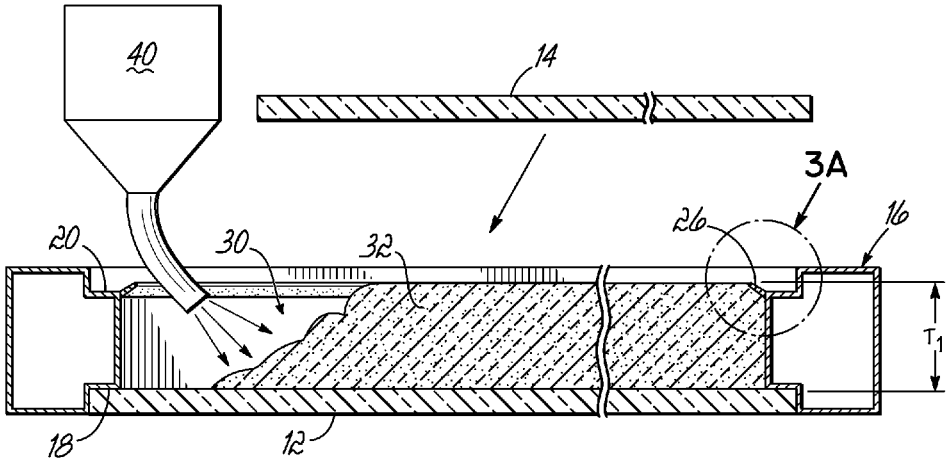
FIG. 3 is a cross-sectional view of the dual glazed framing system shown with a feeder hopper for filling the insulating cavity and the dual glazed framing system shown in the uncompressed step.
Figure 3A:
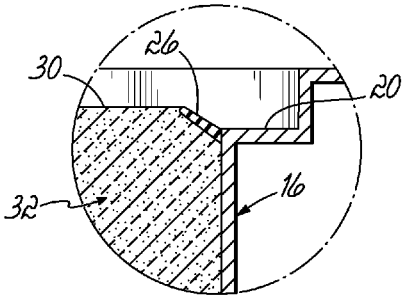
FIG. 3A is a close-up cross-sectional view of the movable fill guide shown in the uncompressed step with translucent insulating particulate material filed to the top of the movable fill guide.

As shown in FIG. 3, the dual glazed framing system 6 further includes a movable fill guide 26 attached to the frame 16 at the edge, adjacent to ledge 20. The movable fill guide 26 facilitates filling the framing system with the translucent insulating material 24. In particular, the movable fill guide 26 is adapted to allow for the compression of the translucent insulating particulate material as it is sealed between the first glazing panel 12 and the second glazing panel 14, into the insulating cavity 22. For example, the movable fill guide 26 may comprise a flexible material that flexes downwardly in response to compression of the translucent insulating material 24. In that manner, the movable fill guide 26 allows for the proper level of compression of the translucent insulating material 24. In other words, as shown in close-up in FIG. 3A, the translucent insulating particulate material 24 fills the entire cavity to the top of the movable fill guide 26. The second panel 14 forces the fill guide into the cavity in turn compressing the filler. Thus, the size of the fill guide defines the compression. In one embodiment, the movable fill guide 26 is a flexible durometer, which is an elastomeric member attached to the frame 16.

Figure 4A:
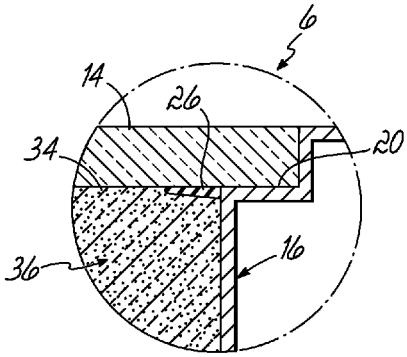
FIG. 4A is a close-up cross-sectional view of the movable fill guide shown in the compressed step with translucent insulating particulate material compressed in the insulating cavity.
Figure 4:
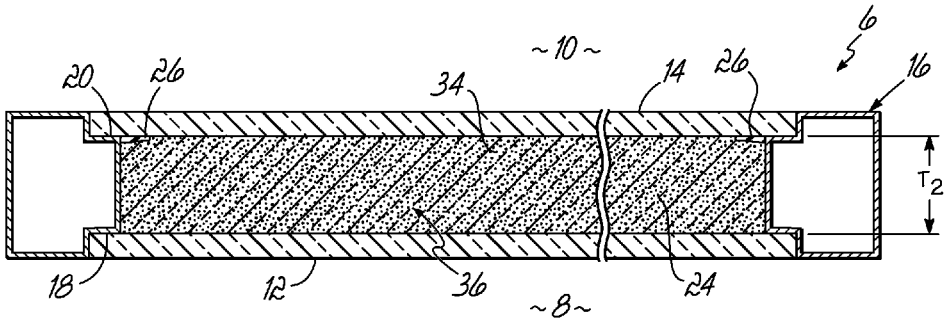
FIG. 4 is a cross-sectional view of the dual glazed framing system shown with the insulating cavity filled with translucent insulating particulate material after the compression step.

With reference now to FIGS. 3 and 4, prior to the compression of the translucent insulating particulate material 24, the first panel 12, the second panel 14, the frame 16, and the movable fill guide 26 of the dual glazed framing system 6 define a first space 30 with a first filler volume 32. After compression, the first panel 12, the second panel 14, the frame 16, and the movable fill guide 26 define a second space 34 with a second filler volume 36, wherein the second volume 36 is less than the first volume 32. For example, before compression, a thickness $T_1$ between the panels 12, 14, may be larger than a second thickness $T_2$ after the translucent insulating particulate material 24 is properly compressed into the insulating cavity 22. In one embodiment, the first filler volume 32 is more than 100% and less than 120% of the second volume 36. However, it can be 110%, or 115%. In another embodiment, the first filler volume 32 is about 108% of the second volume 36.

Figure 6:
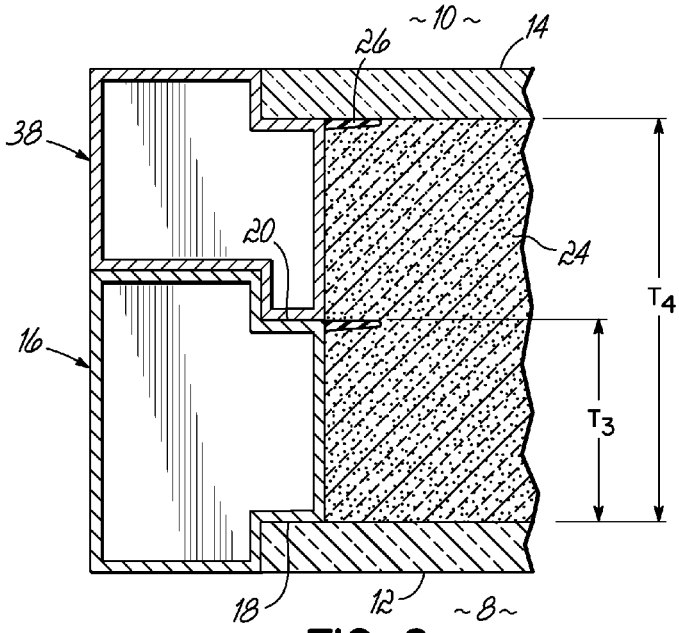
FIG. 6 is a close-up cross sectional view of the frame filler.

As shown in FIG. 6, in another aspect of the invention, the dual glazed framing system 6 further comprises a frame filler 38. The frame filler 38 is adapted to allow the overall distance between the first glazing panel 12 and the opposing second glazing panel 14 to be altered in relationship to the thermal characteristics or performance desired. For example, in a colder geographical location it may be desirable to increase the insulating performance of the system. In such an instance, a thicker frame could be used which would allow for an increased amount of Nanogel or similar material to be compressed or sandwiched between the opposing panels. In such an embodiment, the frame filler 38 is adapted to increase the overall volume of the insulating cavity 22.

In one embodiment, the translucent insulating particulate material 24, such as an aerogel, is resistant to settling due to gravity or other forces. In that way, for example, the dual glazed framing system 6 resists losing insulating efficiency over time. Additionally, as shown in FIG. 1, the dual glazed framing system 6 may be positioned in a substantially horizontal orientation. In other embodiments, the dual glazed framing system 6 may be positioned in a substantially vertical orientation or in any orientation between horizontal and vertical. Furthermore, as will be readily apparent to those of ordinary skill in the art, some embodiments may include various shapes and sizes. For example, one of the glazing panels 12, 14 may be shaped in a bubble, dome, pyramid, ridge, or flat designs.

The present invention also provides for a method for creating a dual glazed framing system 6 comprising the steps of glazing the first panel 12 to the interior portion 8 of the frame 16, filling a cavity formed by the first glazing panel 12 and the frame 6 with a translucent insulating particulate material 24, and glazing the opposing second panel 14 to the exterior portion 10 of the frame 16.

With reference again to FIGS. 3 and 4, in one embodiment, the frame 16 includes a movable fill guide 26 which, when flexed downwardly, decreases the volume of the insulating cavity 22. In such an embodiment, the method may also comprise the step of filling the cavity up to the top of the fill guide 26 and compressing the translucent insulating particulate material 24 into the insulating cavity 22. In that way, as shown in close-up in FIG. 4A, as the second panel 14 compresses the movable fill guide 26 and the filler, the movable fill guide also prevents filler from spilling onto the supporting ledge 20. After the translucent insulating particulate material 24 is properly compressed, the opposing second panel 14 is glazed into proper place on the exterior portion 10 of the frame 16.

Also as shown in FIG. 3, a feed hopper 40, for example, can be used for purposes of depositing the nanogel or like insulating material into the cavity formed by the first glazing panel 12 and the frame 16. Alternatively, other methods of depositing the translucent insulating particulate material known to those skilled in the art may be utilized.

Figure 5:
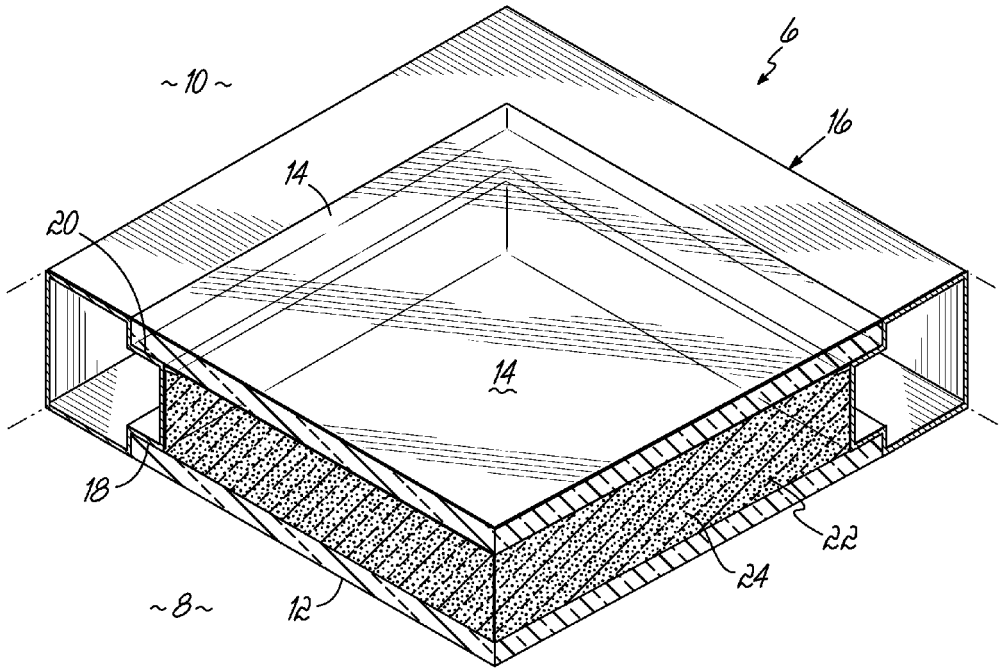
FIG. 5 is a perspective drawing showing the finished dual glazed framing system.

In operation, as shown in FIGS. 3 and 4, the glazing panel 12 is first fit on to the first ledge 18 and then glazed into proper place on the interior portion 8 of the frame 16. An appropriate volume of translucent insulating material 24 is then filled into the cavity created by the first glazing panel 12, the frame 16, and the movable fill guide 26, via the feed hopper 40, for example. The feed hopper 40 is then removed and the opposing second glazing panel 14 is placed on the exterior portion 10 of the frame. The second glazing panel 14 is then forced on to the second ledge 20 of the frame, compressing the translucent insulating particulate material 24 in doing so. The second glazing panel 14 is then glazed into proper place and the movable fill guide 26 adapts to the compression of the translucent insulating particulate material 24 to insure proper compression levels. The dual glazing framing system 6 in FIG. 5 shows the system in its completed form.

While the present invention has been illustrated by description of various embodiments and while these embodiments have been described herein, it is not the intention of the applicants to restrict or in any way limit the scope of the claims. Additional advantages and modifications will readily appear to those skilled in the art. The invention in its broader aspect is, therefore, not limited to the specific details, representative apparatus and method, and illustrative examples shown and described. Accordingly, departures may be made from such details without departing from the spirit or scope of the applicants' general inventive concept.

This has been a description of the present invention, along with the preferred method of practicing the invention currently known to the inventors. However, the invention itself should be defined only by the claims.

Wherein we claim:

1. A dual glazed panel framing system comprising:
- a first glazing panel;
- an opposing second glazing panel;
- a frame having a first ledge adapted to receive the first glazing panel and an opposing second ledge adapted to receive the opposing second glazing panel;
- an insulating cavity positioned between the first glazing panel and the second glazing panel, the insulating cavity being filled with a translucent insulating particulate material in a compressed state; and
- a translucent insulating particulate material movable fill guide attached to the second ledge and extending over the insulating cavity, the movable fill guide adapted to allow for the compression of the translucent insulating particulate material.

2. The dual glazed panel framing system of claim 1 wherein the translucent insulating particulate material is an aerogel.

3. The dual glazed panel framing system of claim 1 wherein the movable fill guide is a flexible durometer attached to the frame.

4. The dual glazed panel framing system of claim 3 wherein the translucent insulating particulate material is an aerogel.

5. The dual glazed panel framing system of claim 4 wherein the volume of the aerogel contained in the insulating cavity measured in an uncompressed state is less than 120% of the volume of the aerogel in said compressed state.

6. The dual glazed panel framing system of claim 4 wherein the volume of the aerogel contained in the insulating cavity measured in an uncompressed state is about 108% of the volume of the aerogel in the compressed state.

7. The dual glazed panel framing system of claim 4 further comprising a frame filler adapted to increase the volume of the insulating cavity.

8. The dual glazed panel framing system of claim 4 wherein the aerogel has material properties that make the aerogel resistant to settling due to gravity or other forces.

9. The dual glazed panel framing system of claim 4 positioned in a substantially horizontal orientation.

10. The dual glazed panel framing system of claim 4 positioned in a substantially vertical orientation.

11. The dual glazed panel framing system of claim 4 positioned in an orientation between horizontal and vertical.

12. The dual glazed panel framing system of claim 1 wherein at least one of the first or second glazing panels is shaped in a bubble, dome, pyramid, ridge, or flat design.

13. A dual glazed panel framing system comprising:
- a first glazing panel;
- an opposing second glazing panel;
- a frame having a first ledge adapted to receive the first glazing panel and an opposing second ledge adapted to receive the opposing second glazing panel;
- an insulating cavity positioned between the first glazing panel and the second glazing panel, the insulating cavity being filled with a translucent insulating aerogel in a compressed state;
- a translucent insulating particulate material movable fill guide attached to the second ledge and extending over the insulating cavity, the movable fill guide adapted to allow for the compression of the translucent insulating particulate material;
- wherein the moveable fill guide is a flexible durometer attached to the frame; and
- wherein the volume of the aerogel contained in the insulating cavity measured in an uncompressed state is approximately 108% of the volume of the aerogel in the compressed state.

14. The dual glazed panel framing system of claim 13 further comprising a frame filler adapted to increase the volume of the insulating cavity.

15. A method for creating a dual glazed framing system comprising:
- glazing a first panel to a frame, such that a cavity is formed by the first panel, the frame, and a moveable fill guide attached to the frame opposite the first panel at an angle above horizontal and extending above the first panel, the cavity defining a first volume;
- filling the cavity with a translucent insulating particulate material;
- compressing a second panel against said particulate material and the moveable fill guide and reducing said first volume to a second volume, by flexing the moveable fill guide into the cavity; and
- glazing said second panel to the frame.

16. The method of claim 15 wherein the translucent insulating particulate material is an aerogel.

17. The method of claim 15 wherein the movable fill guide is a flexible durometer.

18. The method of claim 15 wherein the first volume is less than 120% of the second volume.

19. The method of claim 15 wherein the first volume is approximately 108% of the second volume.

20. The method of claim 15 wherein the step of filling the insulating cavity is performed using a feed hopper for the purposes of depositing the translucent insulating material into the insulating cavity.

* * * * *

UNITED STATES PATENT AND TRADEMARK OFFICE

CERTIFICATE OF CORRECTION

PATENT NO. : 8,381,490 B2
APPLICATION NO. : 12/855993
DATED : February 26, 2013
INVENTOR(S) : Mark A. Back et al.

It is certified that error appears in the above-identified patent and that said Letters Patent is hereby corrected as shown below:

In the Specification:

Column 3, line 12 reads, "... particulate material filed to the top of ..." should read -- ... particulate material filled to the top of ... --.

Signed and Sealed this
Twenty-third Day of April, 2013

Teresa Stanek Rea
*Acting Director of the United States Patent and Trademark Office*